US007316236B2

(12) United States Patent
Hoser

(10) Patent No.: US 7,316,236 B2
(45) Date of Patent: Jan. 8, 2008

(54) CLEANING DEVICE FOR THE SHAVING HEAD OF A DRY SHAVING APPARATUS

(75) Inventor: Jurgen Hoser, Neu-Anspach (DE)

(73) Assignee: Braun GmbH, Kronberg (DE)

( * ) Notice: Subject to any disclaimer, the term of this patent is extended or adjusted under 35 U.S.C. 154(b) by 2 days.

(21) Appl. No.: 10/994,732

(22) Filed: Nov. 22, 2004

(65) Prior Publication Data

US 2005/0126610 A1 Jun. 16, 2005

Related U.S. Application Data

(63) Continuation of application No. PCT/EP02/12889, filed on Nov. 18, 2002.

(30) Foreign Application Priority Data

May 23, 2002 (DE) ..... 102 22 716

(51) Int. Cl.
*B08B 3/02* (2006.01)

(52) U.S. Cl. ..... 134/166 R; 134/169 R; 134/170; 134/135

(58) Field of Classification Search ..... 134/166 R, 134/169 R, 170, 135, 109, 111, 116
See application file for complete search history.

(56) References Cited

U.S. PATENT DOCUMENTS 1,865,289 A * 6/1932 Trowbridge ..... 134/103.1
1,868,904 A * 7/1932 Johnston ..... 206/208
1,899,657 A * 2/1933 Zademach ..... 134/104.4
2,352,356 A * 6/1944 Albertson ..... 134/111
2,675,012 A * 4/1954 Scales ..... 134/85
3,148,396 A * 9/1964 Smith ..... 15/88.3
3,172,416 A * 3/1965 Simmons ..... 134/111
3,332,099 A * 7/1967 Reiter ..... 15/21.1
3,365,267 A * 1/1968 Mekiney et al. ..... 422/116
3,372,704 A * 3/1968 Ashworth ..... 134/109
3,447,892 A * 6/1969 Clark et al. ..... 422/291
3,478,758 A * 11/1969 Davies ..... 134/85
3,529,610 A * 9/1970 Leichner et al. ..... 134/104.1
3,759,594 A * 9/1973 Cobb ..... 312/31
4,054,963 A * 10/1977 Taylor ..... 15/310
4,541,138 A * 9/1985 Varrial ..... 15/88.3

(Continued)

FOREIGN PATENT DOCUMENTS

CH 683750 * 5/1994

(Continued)

OTHER PUBLICATIONS

European Patent Office 0 114 026 Jul. 1984.*

*Primary Examiner*—Frankie L. Stinson
(74) *Attorney, Agent, or Firm*—Fish & Richardson, P.C.

(57) ABSTRACT

A shaving head cleaning device includes a housing, a receptacle configured to receive the dry shaving apparatus, a receiving region configured to receive the shaving head of the dry shaving apparatus, a reservoir for containing cleaning fluid, a supply conduit connecting the reservoir to the receiving region, and a return conduit connecting a bottom area of the receiving region to the reservoir. The receptacle is constructed in a trough shape to receive the dry shaving apparatus in a substantially horizontal position, and an outlet of the supply conduit is directed at a top portion of the inserted shaving head.

28 Claims, 3 Drawing Sheets

U.S. PATENT DOCUMENTS

| | | | | | |
|---|---|---|---|---|---|
| 4,784,169 | A | * | 11/1988 | Striedieck | 134/111 |
| 4,838,949 | A | | 6/1989 | Dugrot | |
| 5,147,575 | A | * | 9/1992 | Hampton, Sr. | 422/28 |
| 5,168,888 | A | * | 12/1992 | Altwasser | 134/181 |
| 5,385,160 | A | * | 1/1995 | Brinkman | 134/186 |
| 5,426,806 | A | * | 6/1995 | Johnson et al. | 15/88.4 |
| 5,484,858 | A | * | 1/1996 | Smits et al. | 525/393 |
| 5,560,066 | A | * | 10/1996 | McDivitt | 15/88.3 |
| 5,614,030 | A | * | 3/1997 | Braun | 134/22.1 |
| 5,649,556 | A | | 7/1997 | Braun | |
| 5,742,965 | A | * | 4/1998 | Leask | 15/21.1 |
| 5,921,278 | A | * | 7/1999 | Wallace et al. | 137/563 |
| 6,131,230 | A | * | 10/2000 | Manabat | 15/104.92 |
| 6,363,952 | B1 | * | 4/2002 | Baioff et al. | 134/111 |
| 6,371,136 | B1 | | 4/2002 | Hoser | |
| 6,454,875 | B1 | * | 9/2002 | Vogel | 134/32 |
| 6,565,819 | B1 | * | 5/2003 | Herrera | 422/298 |
| 6,626,194 | B2 | * | 9/2003 | Wong | 134/102.2 |
| 2004/0255990 | A1 | * | 12/2004 | Taylor | 134/94.1 |

FOREIGN PATENT DOCUMENTS

| | | | |
|---|---|---|---|
| DE | 44 02 237 | | 3/1995 |
| DE | 44 15 473 | * | 11/1995 |
| DE | 199 18 287 | | 2/2000 |
| DE | 199 14 094 | * | 12/2000 |
| FR | 2 568 111 | | 7/1984 |
| GB | 2 200 559 | * | 8/1988 |
| JP | 5-300868 | * | 11/1993 |
| JP | 6-178876 | * | 6/1994 |
| JP | 8-332405 | * | 12/1996 |
| JP | 2001-96082 | * | 4/2001 |

* cited by examiner

CLEANING DEVICE FOR THE SHAVING HEAD OF A DRY SHAVING APPARATUS

CROSS-REFERENCE TO RELATED APPLICATIONS

This is a continuation of PCT Application No. PCT/EP02/12889, filed on Nov. 18, 2002, which claims priority to German Patent Application No. 102 22 716.0, filed on May 23, 2002, which is incorporated herein by reference in its entirety.

TECHNICAL FIELD

This invention relates to a shaving head cleaning device.

BACKGROUND

Cleaning devices can be used to clean shaving heads of dry shaving apparatus. In one such device described in DE 44 02 237 C1, the dry shaving apparatus is inserted into the receptacle in a substantially vertical orientation with its shaving head facing downward. At the beginning of the cleaning cycle, cleaning fluid is conveyed by a pump from a reservoir into the receptacle, such that the shaving head becomes completely immersed in the cleaning fluid. To provide cleaning action, the cleaning fluid is continuously flushed through the receptacle during the cleaning cycle.

SUMMARY

In one aspect of the invention, a receptacle of a cleaning device is constructed in a trough shape to enable the near-horizontal insertion of the dry shaving apparatus therein. The receptacle is positioned adjacent a receiving region of the cleaning device in which the shaving head is positioned when the dry shaving apparatus rests within the receptacle. A supply conduit leads from a cleaning liquid reservoir to a top area of the receiving region, and a return conduit is routed from a bottom area of the receiving region back to the cleaning liquid reservoir.

Cleaning of the shaving head is performed by spraying the cleaning fluid into the receiving region. The spraying action can advantageously dislodge hair residues and deposits from the shaving head. As a result of the cutter parts in the shaving head being moved during the cleaning, the cleaning fluid can be aspirated (e.g., suctioned) into the shaving head. Consequently, a substantially uniform distribution of the cleaning fluid and wetting of the cutter parts can be achieved.

Furthermore, the movement of the cutter parts can create a bubbling effect within the cleaning fluid, which can enhance the cleaning process. For example, small droplets of the cleaning fluid can impact the shaving head during the spraying action. After the droplets pass through a shaving foil of the shaving head, the droplets reach the moving cutter parts. Upon impacting the cutter parts, the droplets are further divided and mixed with air to form bubbles. The sonic energy released when the bubbles burst can promote the dislodging of deposits and hair residues. In some cases, the cleaning effect of the droplets can be greater than that of a fluid jet or a bath.

On account of the sprayed cleaning fluid, the cleaning device requires considerably less cleaning fluid than other cleaning devices. Consequently, the pump can run at a lower speed, which can result in less noise.

To facilitate draining of the cleaning fluid from the receptacle, the receptacle can be inclined toward the receiving region at an angle relative to the horizontal (e.g., relative to a support surface of the cleaning device during use) of about 0° to about 20° (e.g., about 3° to about 15°, about 5°).

The cleaning fluid can be sprayed onto the shaving head in the receiving region through a nozzle fluidly connected to the supply conduit. The spray pattern of the cleaning fluid can be a function of the nozzle shape. For example, fine distribution of the cleaning fluid over a large surface area can generally be accomplished with a flat-jet nozzle. An advantage of flat-jet nozzles is that a large area of the shaving head can be struck with cleaning fluid from a short distance through fanning of the fluid jet. Consequently, it is possible to position the flat-jet nozzles in relatively close proximity to the shaving head, thus enabling the receiving region to be relatively small. Under certain circumstances, it may suffice to use one flat-jet nozzle for spraying the cleaning fluid. In such cases, the cleaning device can be constructed particularly economically.

As another example, spot-jet nozzles can be used to spray the cleaning fluid onto the shaving head. On account of the geometry of the jets, the area impacted by the cleaning fluid is generally small when the distance between nozzle and shaving head is small. The cleaning fluid emitted from the jet nozzles can be aspirated by the moving cutter parts into the shaving head and distributed there. By arranging two or more nozzles at selected sites it is possible to strike substantially the complete surface of the shaving head with cleaning fluid. An advantage of spot-jet nozzles is their relatively simple construction.

To prevent cleaning fluid from escaping as a result of the horizontal arrangement of the dry shaving apparatus, the opening of the receiving region can be shaped to conform to the contour of the dry shaving apparatus (e.g., the contour of the shaving head). A flexible collar seal can be arranged at the junction of the receptacle and the receiving region. The flexible seal can provide sealing effect around the dry shaving apparatus when positioned in the receptacle during use. For example, the flexible seal can help to prevent the cleaning fluid from escaping the receiving region of the cleaning device. Consequently, areas of the dry shaving apparatus other than the shaving head can remain substantially dry during the cleaning process.

Cleaning fluid may escape, however, if the dry shaving apparatus is incorrectly inserted or the collar seal is damaged. A bypass leading from the bottom region of the receptacle to the reservoir for the cleaning fluid allows the escaped cleaning fluid to be returned to the reservoir. Advantageously, the bypass leads near the collar seal into the bottom region of the receptacle and extends essentially parallel to the return conduit. Consequently, the bypass and the return conduit can share a common component (e.g., a common wall) in some embodiments.

During the cleaning process, the hair residues and deposits dislodged from the shaving head are conveyed by the cleaning fluid into the reservoir. To facilitate multiple uses of the cleaning fluid, the dislodged particles can be separated from the cleaning fluid. The separation of the particles from the cleaning fluid can be performed by a filter element and/or by the reservoir for the cleaning fluid. In some embodiments, the cleaning fluid is directed to a selected region on the bottom of the reservoir to facilitate settling of the discharged particles on the bottom of the reservoir. In certain embodiments, the reservoir includes a structure that is conducive to settling to further enhance the settling of the particles therein. For example, a stepped cascade of cup-shaped collecting containers, whose uppermost collecting container is arranged underneath the return conduit leading into the reservoir, can be provided in the reservoir. The cleaning fluid flowing back into the reservoir is routed via the individual collecting containers of the cascade. The particles entrained in the fluid are allowed to settle in the various collecting containers, with the result that at the end of the cascade the cleaning fluid is loaded with substantially fewer particles. Consequently, the cleaning fluid available for the next cleaning cycle is loaded with few particles and can have a higher cleaning impact. In such embodiments, a smaller filter element or no filter element can be used.

To achieve or intensify the cleaning and settling effect, the reservoir can include an inclined surface. The inclined surface can include a filter material. For example, the inclined surface can be formed of a filter material, such as a mesh material.

To simplify cleaning of the reservoir, the reservoir can be designed as a separate component suitable for insertion into a recess of the housing.

In certain embodiments, the reservoir includes a lowermost point at which the cleaning fluid collects to facilitate removal of the cleaning fluid from the reservoir. Arranging the outlet opening for the supply conduit in this region can ensure the effective use of cleaning fluid, particularly when the level in the reservoir is relatively low. The bottom of the reservoir, for example, can be inclined toward the outlet point to cause the cleaning fluid to collect in the lowermost point.

Furthermore, the inclined arrangement of the reservoir can be used to lock the reservoir. For example, the reservoir can be inserted into the cleaning device and moved over an inclined plane into its locked position where it snap-locks into place. The correct position of the reservoir within the cleaning device can be indicated to the user by the snap action in some embodiments.

In some embodiments, the reservoir has at least one transparent wall section, preferably a viewing window. In such embodiments, the user can determine the fluid level in the reservoir as the reservoir can be seen through a cutout in the housing of the cleaning device. Similarly, the user can determine when to replace the reservoir by examining the prevailing conditions within the reservoir. Consequently, the user need not necessarily observe fixed replacement intervals (e.g., based on the number of cleaning operations performed). In a particularly user-friendly embodiment the cleaning device includes a viewing window through which the transparent wall section of the reservoir can be seen. The user can thus look inside the reservoir without first having to remove the reservoir from the cleaning device. Additionally, the viewing window can help to ensure that the inside of the cleaning device is protected from soiling and moisture.

In some embodiments, the cleaning device has a particularly user-friendly design in which the housing includes a storage compartment that is accessible from the outside. The storage compartment can be used to store any of various items, such as a power cord, a guard cap, and/or a brush. The storage compartment can further include divisions and/or holders for various objects. The objects kept in the storage compartment may be particularly well protected from environmental influences or from falling out while being transported if the storage compartment is closed to the outside by a flap, for example. On account of the essentially horizontal arrangement of the dry shaving apparatus and the underlying reservoir for the cleaning fluid, the storage compartment can advantageously be arranged adjacent the reservoir and underneath the dry shaving apparatus.

In certain embodiments, the housing includes a display for indicating operational data, such as the current operating status and/or the charge status of the dry shaving apparatus.

In some embodiments, function buttons for operating the cleaning device are arranged on the housing.

In certain embodiments, the shaving head is dried in a current of air after cleaning is completed. For example, a fan for producing the air current and directing it onto the shaving head can be arranged in the interior of the housing. The fan can be arranged near the shaving head, thus enabling the air current to be directed onto the shaving head over a short route. The air can be directed to the shaving head through a channel. It is possible to reduce the risk of adverse smells and other nuisances by arranging a filter element (e.g., an activated carbon filter element) in the channel.

The dry shaving apparatus can be electrically connected to the cleaning device by way of a corresponding contact device. In certain embodiments, a wall of the trough-shaped receptacle includes a contact device through which the dry shaving apparatus, when inserted in the receptacle, can be connected to a charging system (e.g., an inductive-type charging system) for the dry shaving apparatus. The charging system is used to control the dry shaving apparatus during the cleaning process in some embodiments.

The shaving head can be activated at least temporarily during the cleaning in order to enhance the cleaning process. Activating and deactivating the dry shaving apparatus during the cleaning process may be particularly easy if the dry shaving apparatus can be inserted into the cleaning device with its operating switch facing down. For example, the operating switch of the dry shaving apparatus can inlcude a reed contact switch, which can be activated with an electromagnet that is arranged in the receptacle opposite the operating switch. The receptacle can include a recess for the operating switch, ensuring that the dry shaving apparatus is securely located in the receptacle. Charging and switching the dry shaving apparatus during the cleaning process can alternatively or additionally take place by inductive coupling or by external sealed electric contacts.

Aspects of the invention can provide one or more of the following advantages. In some embodiments, the cleaning device can increase (e.g., optimize) the cleaning effect with a small (e.g., minimum) amount of circulation of the cleaning fluid. In certain embodiments, the cleaning device produces little noise and has a simple construction. In some embodiments, the cleaning process is performed quickly relative to conventional methods. In certain embodiments, the cleaning device can reduce the stirring up of hairs and deposits that have settled in the reservoir. In some embodiments, the amount of cleaning fluid consumed by the cleaning device can be reduced. In certain embodiments, the length of the cleaning process can be reduced. Features and advantages of the invention are in the description, drawings, and claims.

DESCRIPTION OF DRAWINGS

Like reference symbols in the various drawings indicate like elements.

DETAILED DESCRIPTION

Figure 1:
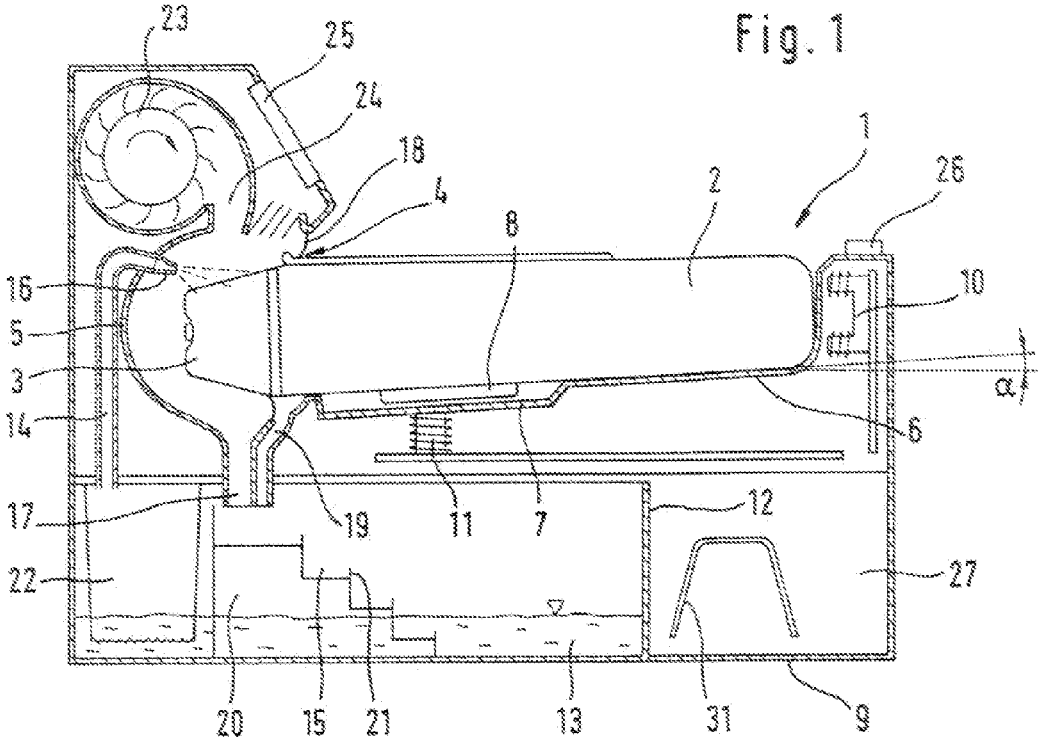
FIG. 1 is a cross-sectional view of an embodiment of a cleaning device.

FIG. 1 shows a cleaning device with a housing 1 in which a dry shaving apparatus 2 is positioned. The shaving head 3 of the dry shaving apparatus 2 is arranged in an opening 4 of a receiving region 5. The dry shaving apparatus 2 is positioned in a trough-shaped receptacle 6 conforming to the contour of the dry shaving apparatus 2 to secure the dry shaving apparatus 2 within the housing 1. The receptacle 6 defines a recess 7 that accommodates an operating switch 8 of the dry shaving apparatus 2. A bottom surface of the receptacle 6 is inclined at an angle of about 5° relative to a support surface 9 of the housing 1.

The housing 1 includes an inductive charging system that includes a contact device 10. The contact device 10 can provide electrical contact to electrically charge the dry shaving apparatus 2, and can lock the dry shaving apparatus 2 within the receptacle 6 to prevent removal of the dry shaving apparatus 2 during the cleaning process. Underneath the operating switch 8 and inside the housing 1 is an electromagnet 11 that cooperates with a reed contact switch in the dry shaving apparatus 2 to actuate the dry shaving apparatus 2.

In the housing 1 underneath the dry shaving apparatus 2 is an exchangeable reservoir 12 for a cleaning fluid 13. The cleaning fluid 13 can be conveyed into the receiving region 5 through a supply conduit 14 by means of a pump, for example. Arranged on the end of the supply conduit 14 directed toward the receiving region 5 is a flat-jet nozzle 16. The flat-jet nozzle 16 is directed at the shaving head 3 of the dry shaving apparatus 2. The cleaning fluid 13 is sprayed through the flat-jet nozzle 16 onto the upper area of the shaving head 3. As a result of the movement of the cutter parts within the shaving head 3, the cleaning fluid 13 is distributed throughout the shaving head 3. In the lower area of the receiving region 5 is a return conduit 17 through which the accumulating cleaning fluid 13 is directed back into the reservoir 12.

To prevent cleaning fluid from escaping from the opening 4, a collar seal 18 is arranged around the opening 4. The collar seal 18, for example, can seal the joint between the shaving head 3 and the opening 4. In some instances, cleaning fluid may still escape to the outside, however, when the dry shaving apparatus 2 is removed after the cleaning process is completed. A bypass 19 arranged in the area of the opening 4 enables the return of the escaped cleaning fluid 13 to the reservoir 12.

The reservoir 12 for the cleaning fluid 13 contains a cascade 20 of cup-shaped or groove-shaped collecting containers 15. The cascade 20 has a step-shaped configuration and is arranged with its uppermost collecting container 15 positioned underneath the return conduit 17 that leads into the reservoir 12. Each collecting container 15 of the cascade 20 has a throttling element 21 on the way to the next lower collecting container 15. With this throttling element 21, which takes the form of a wall, a calmed zone is created in each collecting container 15, enabling the particles entrained by the cleaning fluid 13 to settle. By the time the cleaning fluid 13 reaches the lowest collecting container 15, the cleaning fluid 13 is loaded with fewer hair residues and other particles than at the beginning of the cascade. Consequently, the cleaning fluid 13 that reaches the bottom of the reservoir 12 is less soiled. The particles remaining in the cleaning fluid 13 can subsequently settle on the bottom of the reservoir 12. A filter element 22 is used to rid the cleaning fluid 13 of the particles still remaining therein when conveyed back to the receiving region 5.

Arranged above the receiving region 5 is a fan 23. After completion of the cleaning of the shaving head, the current of air produced by the fan 23 is directed through a channel 24 onto the shaving head 3 in order to dry the shaving head (e.g., by facilitating evaporation of the cleaning fluid).

Provided in the area of the fan 23 is a display 25 for indicating information about the cleaning process and the charging status of the dry shaving apparatus 2. The various functions of the cleaning device 1 can be set using function buttons 26.

The housing 1 further includes a storage compartment 27 positioned adjacent the reservoir 12. The storage compartment 27 can offer sufficient room to accommodate a guard cap 31 and/or a power cord of the dry shaving apparatus 2, for example. The storage compartment can be closed with a flap in some embodiments.

Figure 2:
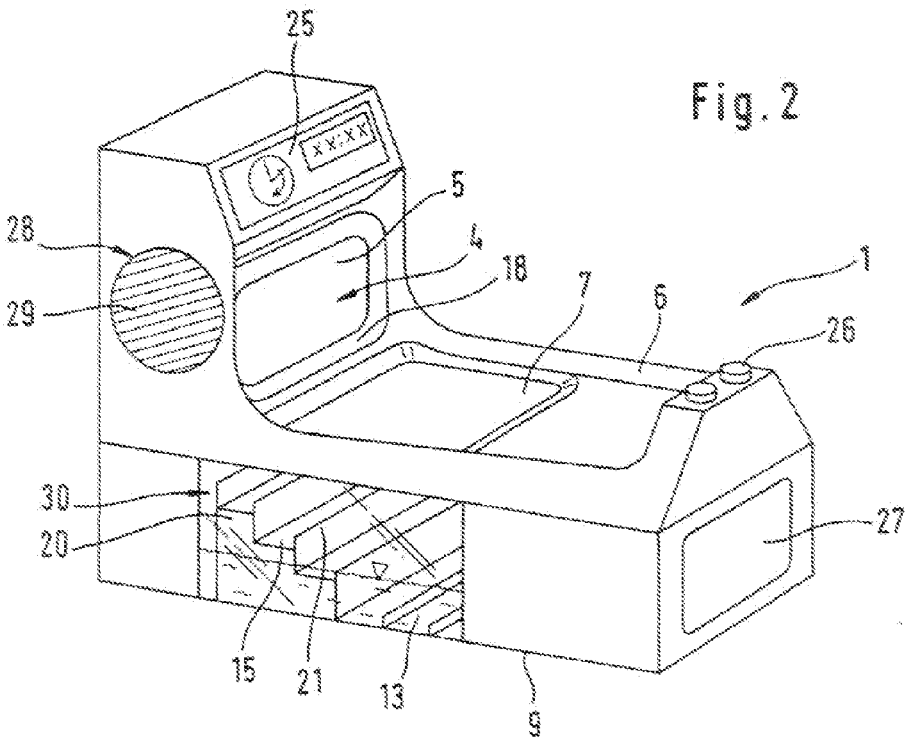
FIG. 2 is a perspective view of the cleaning device of FIG. 1.

In FIG. 2 the cleaning device is shown without the dry shaving apparatus. In the area of the receiving region 5 on the front of the housing 1 is another opening 28 in which an activated carbon filter element 29 is positioned. The current of air produced by the fan 23 to dry the shaving head 3 exits the cleaning device via the activated carbon filter element 29.

On the front of the housing 1 underneath the holding part 7 is a viewing window 30. Through the viewing window 30, the user can see the reservoir 12, which in this area has a transparent wall. The user of the cleaning device is thus able to determine the level and the degree of soiling of the cleaning fluid 13.

Figure 3:
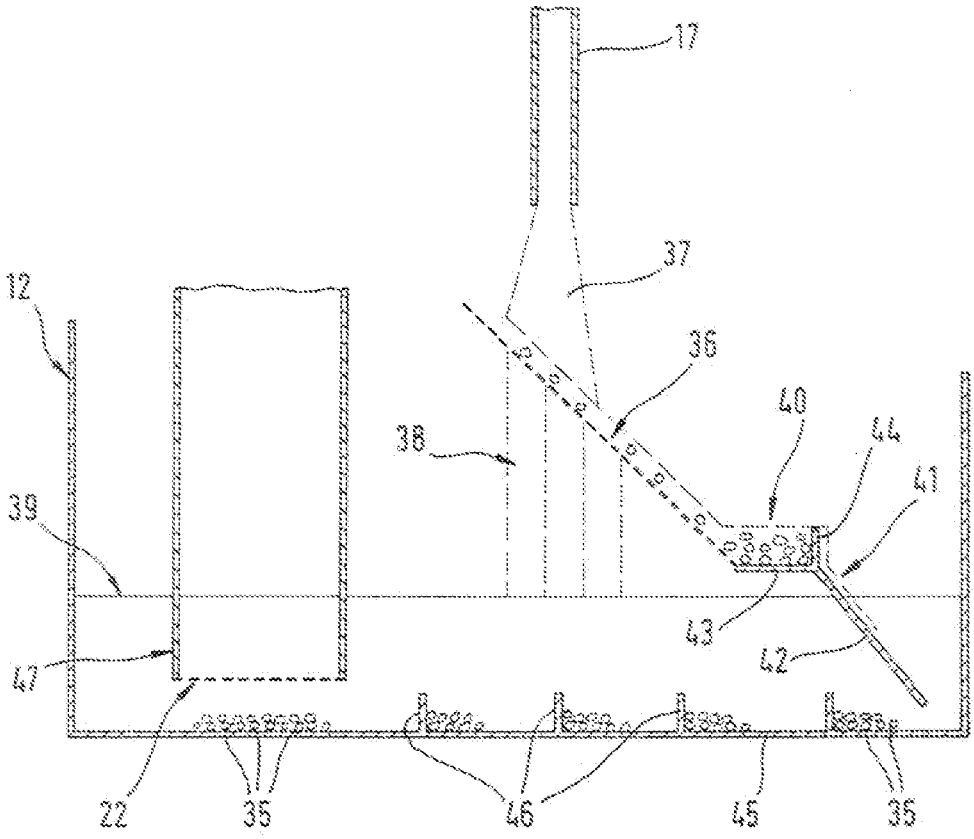
FIG. 3 is a cross-sectional schematic view of a reservoir of an embodiment of a cleaning device.

FIG. 3 shows a cross section of an embodiment of the reservoir 12 for the cleaning fluid. In lieu of or in addition to the cascade-shaped section of FIG. 1 it is possible, in order to improve the settling of particles 35, to provide an inclined filter element 36 in the reservoir, through which the current 37 of cleaning fluid entering from the return conduit 17 is directed. The filter element 36 can be formed of a mesh-like fabric, for example. The mesh-like fabric of the filter element 36 traps coarser particles, and a first partial current 38 is directed to the cleaning fluid already present in the reservoir 12 up to a level 39. The remaining cleaning fluid and particles trapped by the filter element 36 pass—as the result of the descending force—to a settling basin 40 arranged above the fluid level 39. Here the entrained particles can be retained to an amount dictated by the height of the settling basin 40, while the second partial current 41 of cleaning fluid is fed into the existing volume of fluid via an inclined baffle plate 42 that adjoins the settling basin 40. The inclined baffle plate 42 calms the second partial current 41 after it leaves the settling basin 40, enabling it to flow gently into the existing cleaning fluid without substantially stirring up the particles 35 that have already settled there.

The partial current that is directed via the filter element 36 to the settling basin 40 is greatly decelerated and fanned out along its flow path, thus promoting sedimentation. The descending force acting on the particles is dependent in part upon the angle of inclination of the filter element 36. The angle of inclination can be chosen to ensure that substantially none of the particles stick on the filter element 36. The bottom 43 and/or the side wall 44 of the settling basin 40 can be configured to ensure that the cleaning fluid is fully drained from the settling basin 40. Such a settling basin may alternatively or additionally be positioned upstream of the inclined filter element 36 and underneath the return conduit 17. In such embodiments, the settling basin can calm and preclean the cleaning fluid as the cleaning fluid enters the reservoir 12.

The inclined filter element 36 may also be constructed with a mesh size that changes along the flow path of the second partial current 41. For example, the mesh size can increase from fine to coarse along the flow path so that initially only very fine particles can be conveyed with the first partial current 38.

The reservoir bottom 45 is equipped with ribs 46 to promote settling of the particles 35. The pump dome 47, which is connectible to the supply conduit 14, has at its lower end, which projects into the cleaning fluid, a filter element 22. In certain embodiments, the filter element 22 can be omitted on account of the sedimentation effect provided by the filter element 36, thus resulting in a considerable cost advantage.

Figure 4:
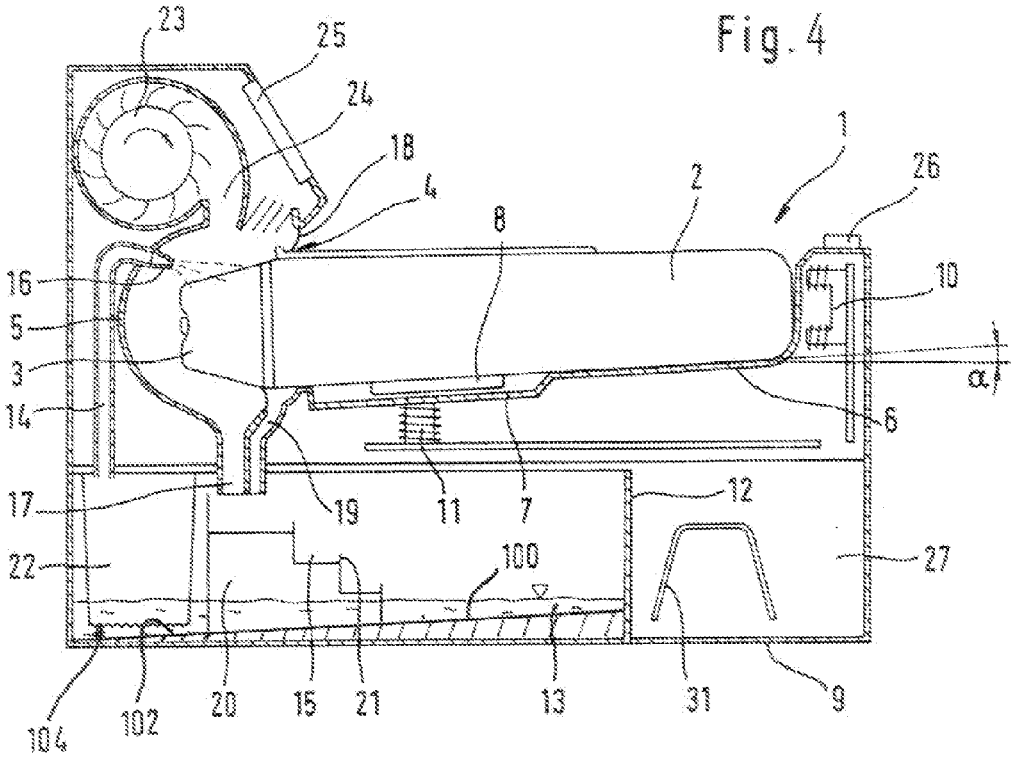
FIG. 4 is a cross-sectional view of another embodiment of a cleaning device.

As shown in FIG. 4, the reservoir 12 can include a surface 100 that is inclined with resrect to support surface 9. The surface 100 may have a lowermost point 102 that is disposed in the vicinity of the outlet of the return conduit 17 and the inlet 104 of the supply conduit 14.

Other embodiments are within the claims.

What is claimed is:

1. A shaving head cleaning device comprising:

a housing;

a receptacle configured to receive a dry shaving apparatus;

a receiving region configured to receive the shaving head of the dry shaving apparatus;

a reservoir for containing cleaning fluid;

a supply conduit connecting the reservoir to the receiving region; and a return conduit connecting a bottom area of the receiving region to the reservoir;

a collar seal arranged at a junction of the receptacle into the receiving region for enclosing the inserted dry shaving apparatus;

wherein the receptacle is constructed in a trough shape to receive the dry shaving apparatus in a substantially horizontal position, and an outlet of the supply conduit is directed at a top portion of the inserted shaving head.

2. The cleaning device of claim 1, wherein the supply conduit leads into an upper area of the receiving region.

3. The cleaning device of claim 1, wherein the receptacle is inclined toward the receiving region at an angle of about 0° to about 20° relative to a support surface of the housing.

4. The cleaning device of claim 1, wherein the supply conduit leads into the receiving region through a nozzle.

5. The cleaning device of claim 1, further comprising a bypass leading from a bottom region of the receptacle to the return conduit to the reservoir.

6. The cleaning device of claim 5, wherein the bypass leads from a region adjacent the collar seal into the bottom region of the receptacle.

7. The cleaning device of claim 5, wherein the bypass extends substantially parallel to the return conduit.

8. The cleaning device of claim 5, wherein the bypass and the return conduit include a common wall.

9. The cleaning device of claim 1, wherein the reservoir is adapted to be inserted into a recess of the housing.

10. The cleaning device of claim 1, wherein the reservoir comprises at least one transparent wall section.

11. The cleaning device of claim 10, wherein the transparent wall section is arranged opposite a viewing window of the housing.

12. The cleaning device of claim 1, wherein the housing comprises a storage compartment accessible from outside the cleaning device.

13. The cleaning device of claim 1, wherein the housing comprises function buttons for operating the cleaning device.

14. The cleaning device of claim 1, further comprising a fan positioned inside the housing to direct an air current onto the shaving head.

15. The cleaning device of claim 14, further comprising a channel, the air current being directed through the channel.

16. The cleaning device of claim 15, further comprising a filter element disposed in the channel.

17. The cleaning device of claim 1, wherein a wall of the trough-shaped receptacle comprises a contact device configured to electrically connect the dry shaving apparatus to a charger.

18. A shaving head cleaning device comprising:

a receiving region adapted to receive the shaving head of a dry shaving apparatus;

an exchangeable container for containing cleaning fluid;

a supply conduit connecting the reservoir to the receiving region; and a return conduit connecting the receiving region to the reservoir;

wherein the exchangeable container comprises a stepped cascade of cup-shaped collecting containers, an uppermost collecting container being arranged underneath an outlet of the return conduit.

19. The cleaning device of claim 1, wherein the reservoir has a bottom surface inclined relative to a support surface of the housing to define a lowermost point therein, the opening of the supply conduit being disposed in a region of the lowermost point such that fluid is collected in the region of the lowermost point at the opening of the supply conduit in the reservoir.

20. The cleaning device of claim 18, wherein the exchangeable container defines a bottom surface inclined relative to a support surface of the device to define a lowermost point therein, an opening of the supply conduit being disposed in a region of the lowermost point such that fluid is collected in the region of the lowermost point at the opening of the supply conduit in the exchangeable container.

21. The cleaning device of claim 18, further comprising a collar seal arranged at the receiving region for enclosing the inserted dry shaving apparatus.

22. The cleaning device of claim 18, further comprising a fan associated with the receiving region to direct an air current onto the shaving head.

23. A shaving head cleaning device comprising:

a housing defining a support surface;

a receptacle configured to receive a dry shaving apparatus;

a receiving region configured to receive the shaving head of the dry shaving apparatus;

a reservoir for containing cleaning fluid;

a supply conduit connecting the reservoir to the receiving region; and a return conduit connecting a bottom area of the receiving region to the reservoir;

a bypass leading from a bottom region of the receptacle to the return conduit to the reservoir;

wherein the bypass and the return conduit include a common wall; and wherein an outlet of the supply conduit is directed at a top portion of the inserted shaving head.

24. The cleaning device of claim 23, further comprising a collar seal arranged at a junction of the receptacle into the receiving region for enclosing the inserted dry shaving apparatus.

25. The cleaning device of claim 23, further comprising a fan positioned inside the housing to direct an air current onto the shaving head.

26. A shaving head cleaning device comprising:

a housing;

a receptacle configured to receive a dry shaving apparatus;

a receiving region configured to receive the shaving head of the dry shaving apparatus;

a reservoir for containing cleaning fluid;

a supply conduit connecting the reservoir to the receiving region; and a return conduit connecting a bottom area of the receiving region to the reservoir;

wherein an outlet of the supply conduit is directed at a top portion of the inserted shaving head; and wherein the reservoir has a bottom surface inclined relative to a support surface of the housing to define a lowermost point therein, the opening of the supply conduit being disposed in a region of the lowermost point such that fluid is collected in the region of the lowermost point at the opening of the supply conduit in the reservoir.

27. The cleaning device of claim 26, further comprising a collar seal arranged at a junction of the receptacle into the receiving region for enclosing the inserted dry shaving apparatus.

28. The cleaning device of claim 26, further comprising a bypass leading from a bottom region of the receptacle to the return conduit to the reservoir; and wherein the bypass and the return conduit include a common wall.

* * * * *